US005975575A

United States Patent [19]

Instance

[11] Patent Number: 5,975,575

[45] Date of Patent: Nov. 2, 1999

[54] LABELS AND MANUFACTURE THEREOF

[76] Inventor: David John Instance, Guinea Hall, Sellindge, Kent TN25 6EG, United Kingdom

[21] Appl. No.: 08/371,620

[22] Filed: Jan. 12, 1995

Related U.S. Application Data

[63] Continuation of application No. 07/842,370, Mar. 27, 1992, abandoned.

[30] Foreign Application Priority Data

Sep. 28, 1989 [GB] United Kingdom ..... 8921925
May 1, 1990 [GB] United Kingdom ..... 9009711

[51] Int. Cl.[6] ..... B42D 1/00

[52] U.S. Cl. ..... 281/2; 156/250; 156/270; 156/298; 281/5; 283/81

[58] Field of Search ..... 281/2, 5; 156/250, 156/267, 270, 298; 283/81

[56] References Cited

U.S. PATENT DOCUMENTS 4,711,686 12/1987 Instance ..... 283/81
4,933,043 6/1990 Instance ..... 156/248

OTHER PUBLICATIONS

GB 2199010 A Instance, Dec. 22, 1986.

*Primary Examiner*—Andrea L. Pitts
*Assistant Examiner*—Monica Smith
*Attorney, Agent, or Firm*—Hill & Simpson

[57] ABSTRACT

A method of producing a succession of self-adhesive labels on a length of release material, which method comprises the steps of:

(a) applying a layer of pressure-sensitive adhesive to a surface of a length of release material;

(b) applying a succession of individual folded sheets to the layer of pressure-sensitive adhesive so as to adhere the folded sheets to the release material, each folded sheet having an upper panel and a lower panel;

(c) applying to the succession of folded sheets on the release material a web of a self-adhesive laminar material whereby the laminar material is adhered by the self-adhesive surface thereof over the succession of folded sheets;

(d) cutting through the laminar material, the folded sheets and the pressure-sensitive adhesive as far as the release material thereby to form the self-adhesive labels, the cutting step being carried out whereby the upper panel of the folded sheet with the laminar material adhered thereto can be pulled away from the lower panel thereby to open the label; and (e) removing from the release material waste portions of the laminar material, of the folded sheets and of the pressure-sensitive adhesive which surround the self-adhesive labels.

33 Claims, 4 Drawing Sheets

LABELS AND MANUFACTURE THEREOF

This is a continuation of application Ser. No. 07/842,370, filed Mar. 27, 1992, now abandoned.

The present invention relates to a method of producing labels and in particular to a method of producing a succession of self-adhesive labels on a length of release material. The present invention also relates to a self-adhesive label.

In the packaging field there is a great demand for high quality pre-printed labels for labelling containers of various types. In order to facilitate the packaging and labelling of containers at a fast rate it is generally required that the labels to be attached to the containers be made available in a form in which they are easy to handle and easy to transfer onto the containers for which they are intended. In one convenient arrangement the labels are self-adhesive labels which are carried in series on a web of release material which is wound into a reel. The Applicant's earlier GB-A-2199010 discloses a method and apparatus for producing labels in which self-adhesive labels are carried directly on a release material.

It is an aim of the present invention to provide an improved method of producing labels which is a development of the Applicant's earlier method.

Accordingly, the present invention provides a method of producing a succession of self-adhesive labels on a length of release material, which method comprises the steps of:

(a) applying a layer of pressure-sensitive adhesive to a surface of a length of release material;

(b) applying a succession of individual folded sheets to the layer of pressure-sensitive adhesive so as to adhere the folded sheets to the release material, each folded sheet having an upper panel and a lower panel;

(c) applying to the succession of folded sheets on the release material a web of a self-adhesive laminar material whereby the laminar material is adhered by the self-adhesive surface thereof over the succession of folded sheets;

(d) cutting through the laminar material, the folded sheets and the pressure-sensitive adhesive as far as the release material thereby to form the self-adhesive labels, the cutting step being carried out whereby the upper panel of the folded sheet with the laminer material adhered thereto can be pulled away from the lower panel thereby to open the label; and (e) removing from the release material waste portions of the laminar material, of the folded sheets and of the pressure-sensitive adhesive which surround the self-adhesive labels.

The present invention also provides a self-adhesive label comprising an upper panel, a lower panel having a self-adhesive rear surface and which is carried on a backing of release material, and a self-adhesive laminar material which is adhered by the self-adhesive surface thereof to the upper surface of the upper panel, the laminar material connecting the upper panel to the lower panel so as to maintain the label in a closed configuration and being configured such that the upper panel can be pulled away from the lower panel to open the label.

The present invention also provides a self-adhesive label comprising an upper panel having at least one hole therethrough adjacent an edge of the upper panel, a lower panel having a self-adhesive rear surface and which is carried on a backing of a release material, the lower panel being separate from the upper panel, the lower and upper panels having been formed from a single folded sheet and having been separated by cutting away of a common folded edge therebetween, and a self-adhesive laminar material which is adhered by the self-adhesive surface thereof to the upper surface of the upper panel, the laminar material extending over the said at least one hole thereby to form at least one self-adhesive exposed portion of the laminar material which is adhered to the lower panel.

The present invention further provides a self-adhesive label comprising a folded sheet having an upper panel, a lower panel, a folded edge connecting the upper and lower panels, a part of the upper panel extending past an edge of the lower panel whereby the rear surface of the folded sheet comprises the rearwardly-directed surfaces of the lower panel and the said part of the upper panel, a self-adhesive laminar material which covers the upper panel and extends past the folded edge to form an end portion thereof and a layer of pressure-sensitive adhesive which coats the rear surface of the folded sheet and the rearwardly directed surface of the end portion of the laminar material.

Embodiments of the present invention will now be described by way of example only with reference to the accompanying drawings, in which.

Figure 1:
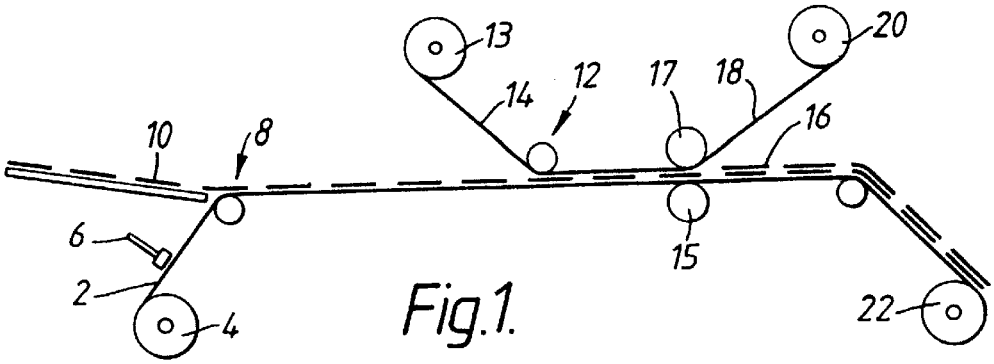
FIG. 1 is a diagrammatic elevation of an apparatus for producing self-adhesive labels in accordance with the present invention.

Referring to FIG. 1, there is shown an apparatus for producing labels in accordance with the method of the present invention. A web of release material 2 is fed out from a reel 4 thereof past an adhesive applicator 6 which is adapted to deposit a layer of pressure-sensitive adhesive (not shown) over the upper surface of the release material 2. The release material 2 typically comprises waxed or siliconized paper. The adhesive may be extruded in a hot melt form and may be extruded either as a continuous uniform layer or in the form of a row of extruded beads. The adhesive-coated release material 2 then passes to a folded sheet applying station 8 at which a succession of individual folded sheets 10 are applied to the layer of pressure-sensitive adhesive so as to adhere the folded sheets 10 to the release material 2. The folded sheets 10 are described in greater detail below. The succession of folded sheets 10 carried on the release material 2 is then passed to a laminar material applying station 12 at which a self-adhesive laminar material 14, which is fed out from a reel 13 thereof, is applied to the succession of folded sheets 10 on the release material 2. The self-adhesive laminar material 14 comprises a layer of plastics material, preferably transparent polyester or polyethylene, coated on one side with a pressure-sensitive adhesive. The laminar material 14 is adhered by the downwardly-directed self-adhesive surface thereof over the succession of folded sheets 10. The laminar material-coated assembly then passes to a die-cutting station 15 at which the self-adhesive labels 16, which will be described in greater detail below, are formed by cutting through the laminar material 14, the folded sheets 10, and the pressure-sensitive adhesive as far as the release material 2. The die-cutting is carried out by a pair of die-cutting rollers 17. At the die-cutting station 15, a waste web remnant 18, consisting of waste portions of the laminar material 14, of the folded sheets 10 and of the pressure-sensitive adhesive which surround the self-adhesive labels 16, is removed from the release material 2 and wound up into a reel 20 for subsequent disposal. The succession of self-adhesive labels 16 on the release material 2 is then wound up into a reel 22 which subsequently can be mounted in an automatic labelling machine (not shown) for automatic application of the labels to containers to be labelled.

Figure 2:
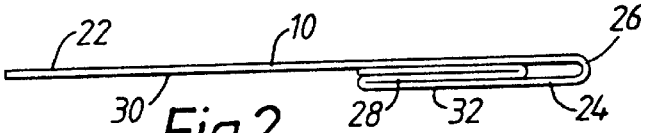
FIG. 2 is a diagrammatic elevation of a folded sheet for incorporation into a self-adhesive label in accordance with a first embodiment of the present invention.

FIG. 2 shows a first embodiment of a folded sheet 10. The folded sheet 10 comprises a rectangular longitudinal strip which is divided into a series of panels by a plurality of transverse fold lines. An upper panel 22 constitutes one end panel of the strip and a lower panel 24 is connected thereto by a folded edge 26 of the folded sheet 10. A number of additional panels 28 are folded between the upper panel 22 and the lower panel 24. It will be seen that the upper panel 22 completely covers and extends past the lower panel 24 so as to have a rearwardly-directed surface 30 which is adjacent the rearwardly-directed surface 32 of the lower panel 24. Accordingly, the rear surface of the folded sheet comprises the rearwardly directed surfaces 30 and 32. As will be described hereinbelow, the upper panel 22 is provided with a row of holes (not shown) extending therethrough, which row is adjacent to the folded edge 26. The holes expose corresponding parts of the lower panel 24.

Figure 3:
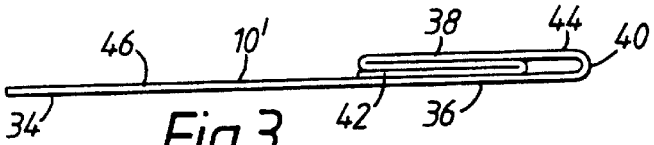
FIG. 3 is a diagrammatic elevation of a folded sheet for incorporation into a self-adhesive label in accordance with a second embodiment of the present invention.

FIG. 3 shows a second embodiment of a folded sheet 10' which is an inverted form of the folded sheet 10 of the first embodiment illustrated in FIG. 2. Thus the lower panel 34 has a rearwardly directed surface 36 which defines the entire rearwardly directed surface of the folded sheet 10'. The upper panel 38 is connected to the lower panel 34 by a folded edge 40. A number of additional panels 42 are disposed between the upper panel 38 and the lower panel 34. The upper surface of the folded sheet 10' consists of the upper surface 44 of the upper panel 38 and the upper surface 46 of that portion of the lower panel 34 which is not covered by the upper panel 38 or the additional panels 42. The upper panel 38 is, in a manner similar to that of the upper panel 22 of the first embodiment shown in FIG. 2, provided with a row of holes (not shown) extending therethrough adjacent the folded edge 40, which holes expose respective parts of the lower panel 34.

Each of the folded sheets 10, 10' of FIGS. 2 and 3 is printed with information relating to the container to be labelled. Preferably, each sheet is lithographically printed but alternative printing methods include letterpress, flexographic or laser printing. Typically, each folded sheet 10, 10' is composed of paper.

Figure 4:
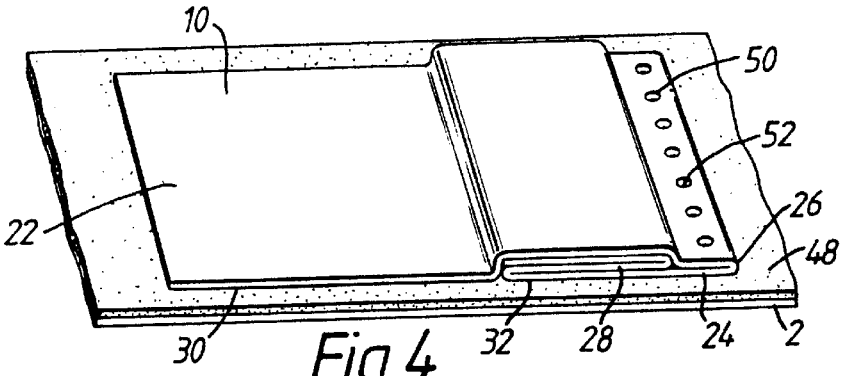
FIG. 4 is a perspective view of the folded sheet of FIG. 2 when adhered to a length of release material by a layer of pressure-sensitive adhesive.
Figure 5:
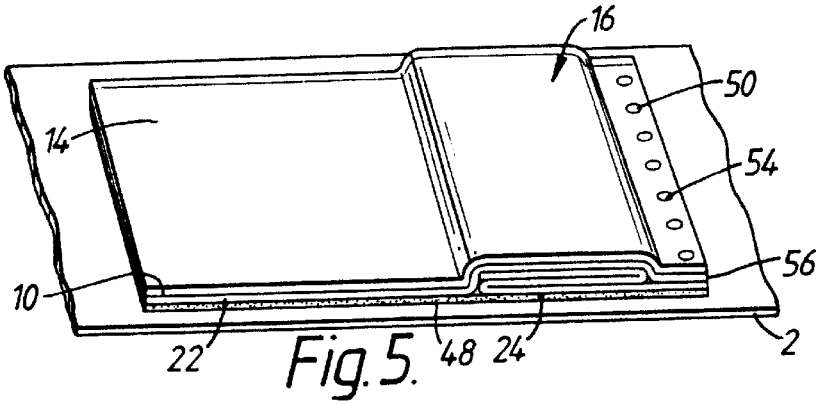
FIG. 5 is a perspective view of the folded sheet assembly of FIG. 4 after application thereover of a self-adhesive laminar material and after die-cutting to produce a self-adhesive label in accordance with the first embodiment of the present invention.
Figure 6:
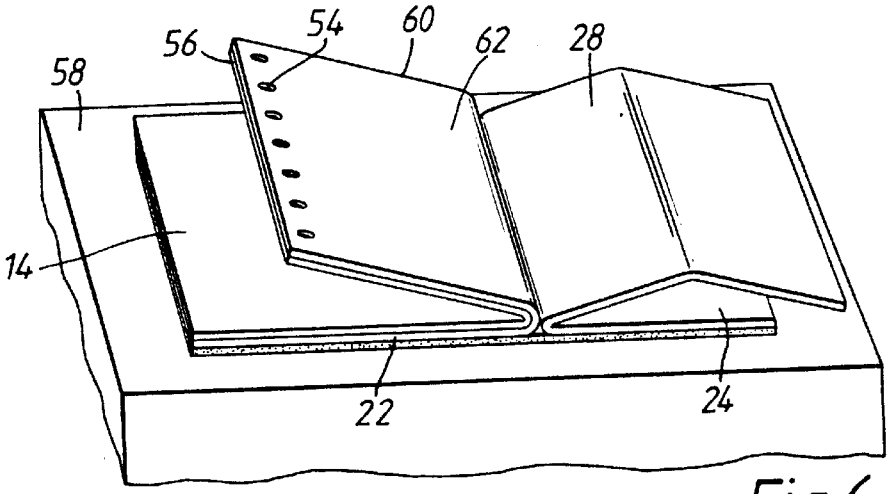
FIG. 6 shows the self-adhesive label of FIG. 5 when adhered to a container and after the label has been opened to reveal previously hidden surfaces.

The following FIGS. 4 to 6 illustrate the manufacture and use of a self-adhesive label 16 employing a folded sheet 10 in accordance with the first embodiment thereof shown in FIG. 2 but it will readily be understood by the man skilled in the art how to manufacture self-adhesive labels incorporating the folded sheets 10' shown in FIG. 3.

FIG. 4 shows a folded sheet 10 which is adhered to the release material 2 by a layer 48 of pressure-sensitive adhesive, the assembly being prior to the laminar material applying station 12. It will be seen that a row of holes 50 extending through the upper panel 22 exposes corresponding parts 52 of the lower panel 24 thereunder. The row of holes 50 is adjacent the folded edge 26 between the upper and lower panels 22, 24. The rearwardly-directed surface 30, 32 of the folded sheet 10 is adhered by the layer 48 of pressure-sensitive adhesive to the release material 2.

The assembly shown in FIG. 4 is then passed to the laminar material applying station 12 and then to the die-cutting station 15 and FIG. 5 shows the resultant assembly after the application of the laminar material 14 and die-cutting of the combined assembly to form the self-adhesive labels 16 on the release material 2. From FIG. 5 it will be seen that the laminar material 14 extends over the whole of the upper surface of the printed sheet 10 and is adhered thereto by the self-adhesive surface thereof. In particular, the laminar material 14 extends over the holes 50 thereby to form corresponding self-adhesive exposed portions 54 of the laminar material 14 which are adhered by the respective self-adhesive surfaces to the corresponding parts 52 of the lower panel 24. During the die-cutting step, the folded sheet 10 has been cut around its periphery so that the resultant self-adhesive label 16 is accurately positioned and aligned on the web of release material 2. This accuracy is important when the label 16 is subsequently to be applied to a container to be labelled by an automatic high speed labelling apparatus. In particular, in the cutting step the folded edge 26 between the upper and lower panels 22, 24 is cut away to form a free outer edge 56 of the upper panel 22. It will be understood that the self-adhesive label 16 is maintained in its closed configuration by the adhesion of the exposed portions 54 of the laminar material 14 to the lower panel 24.

FIG. 6 shows the label 16 of FIG. 5 when adhered to a container 58. As is shown in FIG. 6, when it is desired to open the label 16 and access the concealed panels 28, a user pulls the free outer edge 56 of the upper panel 22 away from the lower panel 24 thereby to release the exposed portions 54 of the self-adhesive laminar material 14 from the lower panel 24. A hinged portion 60 of the upper panel 22, which is not directly adhered to the container 58, is then folded back to reveal the previously hidden inner surface 62 thereof and the additional panels 28 of the label 16 can then be unfolded as shown in FIG. 6. If desired, one or more weakened tear lines may be provided on the additional panels 28 so that one or more of those panels 28 can be torn off from the label 16 which is adhered to the container. When a user has finished reading the information on the label 16, he can re-close the label 16 by folding the hinged portion 60 of the upper panel 22 back over the lower panel 24 and re-adhere the exposed portions 54 of self-adhesive laminar material to the lower panel 24.

Figure 7:
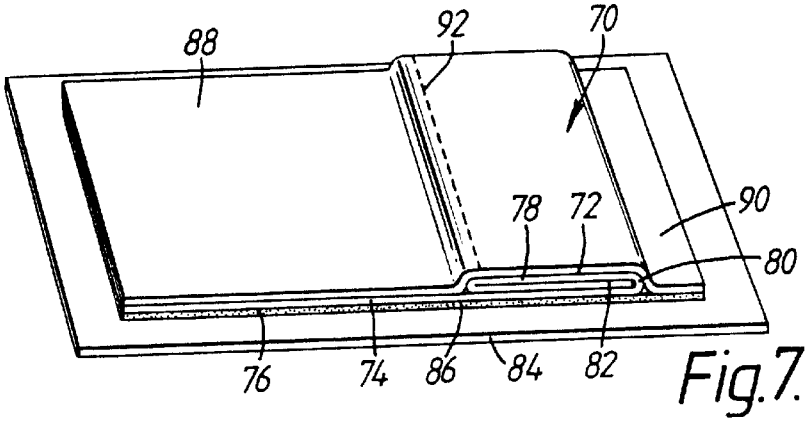
FIG. 7 is a perspective view of a self-adhesive label in accordance with a second embodiment of the present invention.

FIG. 7 shows a self-adhesive label 70 in accordance with a further embodiment of the present invention. The self-adhesive label 70 comprises a folded sheet 72 which is similar in construction to the folded sheet 10' shown in FIG. 3. The folded sheet 72 comprises a rectangular longitudinal strip which is divided into a series of panels by a plurality of transverse fold lines. A lower panel 74 has a rearwardly directed surface 76 which defines the entire rearwardly directed surface of the folded sheet 72. The upper panel 78 is connected to the lower panel 74 by a folded edge 80 and additional panel 82 is disposed between the upper panel 78 and the lower panel 74. The folded sheet 72 is lithographically printed. The rearwardly directed surface 76 of the folded sheet 72 is adhered to a web of release material 84 by a layer 86 of pressure-sensitive adhesive. The folded sheet 72 is entirely covered by a self-adhesive laminar material 88 which is adhered by the self-adhesive surface thereof to the upper surface of the folded sheet 72. A longitudinal end 90 of the laminar material 88 extends past the folded edge 80 and is adhered to the release material 84 by a combination of the self-adhesive surface thereof and the layer 86 of adhesive. Thus the applied folded sheet is shorter than the laminar material. Typically, the adhered end 90 of the laminar material has a width of about 5 mm. A line of perforations 92 extends across the laminar material 88 in the vicinity of the upper panel 78 of the folded sheet 72.

When it is desired to access the concealed surfaces of the folded sheet 72, the perforation line 92 is torn thereby to permit the upper panel 78 and the additional panel 82 attached thereto to be hinged away from the lower panel 74.

The label of FIG. 7 may be made by substantially the same method as that described with reference to FIG. 1. As will be clear, the folded sheet is not provided with a row of holes as in the embodiment of FIGS. 4 to 6 and the folded edge 80 is not cut away from the folded sheet 72. Instead, the leading edge of the resultant self-adhesive label 70 consists of a portion 90 of the laminar material 88 which is adhered to the release material 84 by the layer of adhesive 86. At the die-cutting station 15, the die-cutting rollers are adapted to cut not only the self-adhesive labels but also if desired the die-cutting rollers 17 may cut the perforation line 92 in the laminar material either in the same or in a separate die-cutting step. The die-cutting rollers may be adapted to cut the perforation line 92 additionally through the upper panel 78 of the folded sheet 72. The applied folded sheet may have the configuration shown in FIG. 2 when the folded sheet is also provided with the perforation line.

Figure 8:
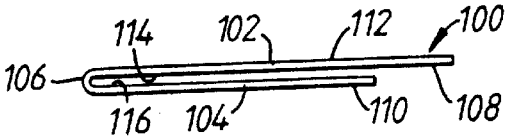
FIG. 8 is a diagrammatic elevation of a folded sheet for incorporation into a self-adhesive label in accordance with a third embodiment of the present invention.
Figure 9:
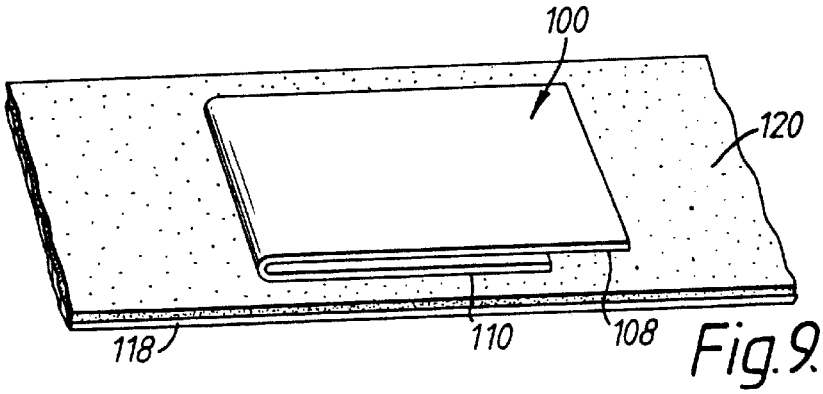
FIG. 9 is a perspective view of the folded sheet of FIG. 8 when adhered to a length of release material by a layer of pressure-sensitive adhesive.

FIG. 8 shows a lithographically-printed folded sheet 100 which is employed in the manufacture of a self-adhesive label in accordance with the third embodiment of the present invention. The folded sheet 100 comprises a rectangular longitudinal strip which is divided into an upper panel 102 and a lower panel 104 which is connected to the upper panel 102 by a folded edge 106 of the folded sheet 100. Although not illustrated, a number of additional panels may be disposed between the upper panel 102 and the lower panel 104. When present, the additional panels are connected to one or both of the upper and lower panels 102, 104. The upper panel 102 completely covers and extends past the lower panel 104 so as to have a rearwardly-directed surface 108 which is adjacent to the rearwardly-directed surface 110 of the lower panel 104. Accordingly, the rear surface of the folded sheet 100 comprises the rearwardly-directed surfaces 108 and 110. The upper surface 112 of the upper panel 102 is lithographically printed as are the opposed inner surfaces 114, 116 of the upper and lower panels 102, 104. The self-adhesive label of the present invention is manufactured by employing the apparatus illustrated in FIG. 1, the description of which will not be repeated. FIG. 9 shows a folded sheet 100 which has been adhered to a length of release material 118 by a layer 120 of pressure-sensitive adhesive, prior to the laminar material applying station 12. The rearwardly-directed surfaces 108, 110 of the folded sheet 100 are adhered by the layer 120 of pressure-sensitive adhesive to the release material 118.

Figure 10:
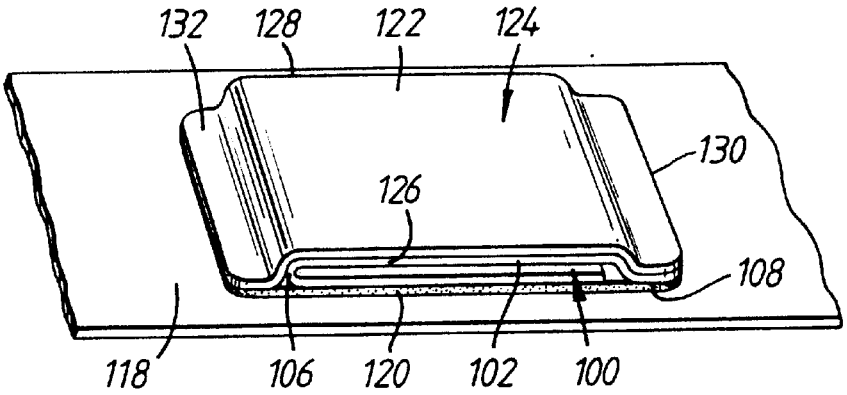
FIG. 10 is a perspective view of the folded sheet assembly of FIG. 9 after application thereover of a self-adhesive laminar material and after die-cutting to produce a self-adhesive label in accordance with the third embodiment of the present invention.

The assembly shown in FIG. 9 is then passed to the laminar material applying station 12 and then to the die-cutting station 15 and FIG. 10 shows the resultant assembly after the application of the laminar material and die-cutting of the combined assembly to form the self-adhesive labels on the release material. The laminar material comprises a transparent plastics material, such as polyester or polyethylene. From FIG. 10 it will be seen that a cut portion of the laminar material 112 constitutes the upper surface of the resultant self-adhesive label 124. During the die-cutting step, the folded sheet 100 has had the longitudinal edges thereof cut away and also the free outer edge of the extending part of the upper panel 102 has also been cut away. The laminar material 122 is coincident with the cut longitudinal edges 126, 128 of the folded sheet 100 and is also coincident with the cut transverse edge 130 of the folded sheet 100. The laminar material 122 extends beyond the folded edge 106 of the folded sheet 100 to form an end flap 132 thereof which is adhered by a combination of its self-adhesive surface and the layer 120 of pressure-sensitive adhesive to the release material 118. The self-adhesive label 124 is maintained in its closed configuration by the adhesion of the rearwardly-directed surface 108 of the upper panel 102 to the release material 118.

Figure 11:
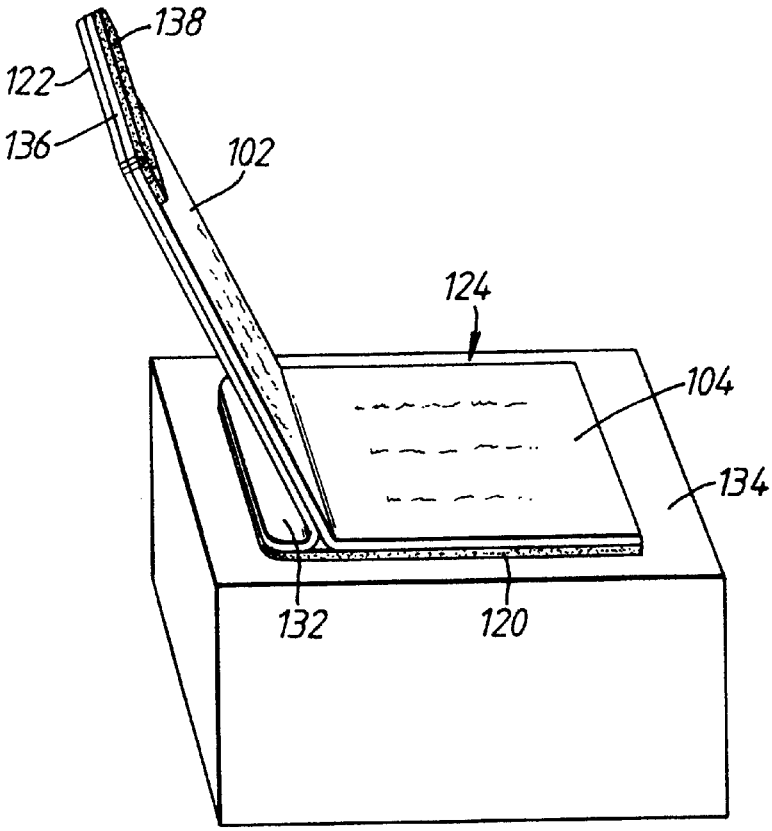
FIG. 11 shows the self-adhesive label of FIG. 10 when adhered to a container and after the label has been opened to over your previously hidden surfaces.

FIG. 11 shows the label 124 of FIG. 10 when adhered to a container 134. The rearwardly-directed surface of the label 124 consists of that portion of the layer of adhesive 120 which is adhered to the rearwardly directed surfaces 108, 110 of the upper and lower sheets 102, 104 and the rearwardly directed surface of the flap 132 of the laminar material 122. When the label 124 is removed from the release material 118, the portion of the layer of adhesive 120 is stripped off therewith and that portion of the layer of adhesive 120 adheres the label 124 to the container 134. When it is desired to open the label 124 and access the concealed surfaces of the upper and lower panels 102, 104, a user pulls the free outer edge 136 of the upper panel 102 away from the lower panel 104. The free outer edge 136 and the part of the layer of pressure-sensitive adhesive 120 which is adhered directly to the rearwardly directed surface 108 of the upper panel 102 are stripped off from the container as a result of preferential adhesion of the adhesive to the rearwardly-directed surface 108 of the upper panel. The portion 138 of the adhesive layer 120 remains adhered to the upper panel 102 as is shown in FIG. 11. When a user has finished reading the information on the label 124, he can re-close the label 124 by folding the upper panel 102 back over the lower panel 104 and by re-adhering the adhesive part 138 to the container 134.

In the embodiment of FIGS. 8 to 11, the folded edge 106 is protected from being accidentally caught and pulled away from the container to which it is adhered by the laminar material 122 which extends over the folded edge 106 to form the flap 132. Thus the resultant label 124 is reliably and securely adhered over its whole surface to the container 134.

As is shown in FIGS. 10 and 11, in the die-cutting step the corners of the label are preferably cut rounded. This is carried out not only for aesthetic purposes but also to assist a user in opening the resultant label and also to reduce the chances of the corners of the label being bent or caught by extraneous objects.

If desired, the layer of pressure-sensitive adhesive 120 may be applied to the release material as a non-continuous layer whereby a corner of the rearwardly directed surface 108 of the outer edge 136 of the upper panel 102 is not coated with adhesive—this assists in a user being able to pull the upper panel 102 away from the lower panel 104 in order to open the label.

Figure 12:
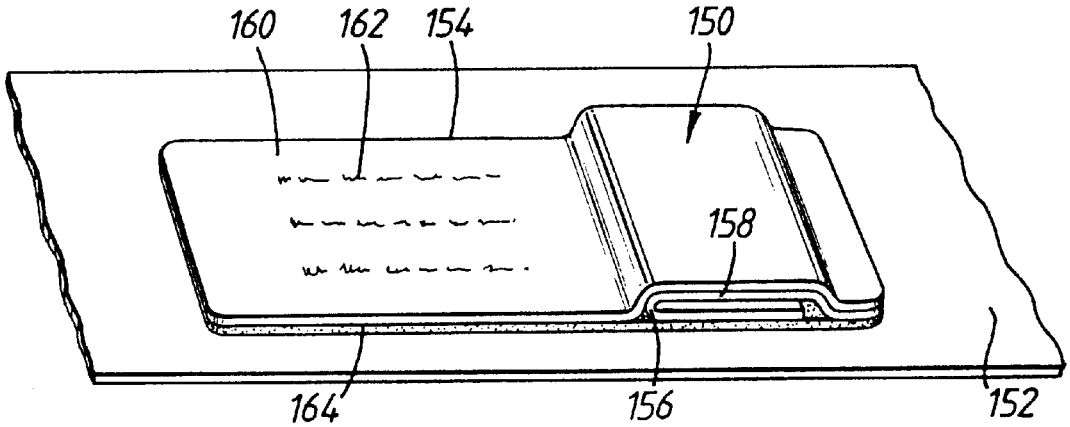
FIG. 12 is a perspective view of a self-adhesive label in accordance with a fourth embodiment of the present invention when carried on a length of release material.

FIG. 12 shows a label 150 in accordance with a fourth embodiment of the present invention when carried on a length of release material 152. This embodiment is different from that illustrated in FIG. 8 to 11 in that the self-adhesive laminar material 154 extends substantially past the folded edge 156 of the folded sheet 158 thereby to define a label portion 160 which is adjacent the folded sheet 158. The self-adhesive laminar material is of transparent plastics such as polyester or polyethylene and has an image 162 printed on the rearwardly-directed surface 164 thereof, which image is disposed in the portion of the label adjacent to the folded sheet. In the manufacture of the labels, the laminar material 14 shown in FIG. 1 would consist of a length of transparent plastics material having a succession of images 162 printed on its lower surface 164. The laminar material 14 would be adhered over the assembly of folded sheets/pressure-sensitive adhesive/release material with the image 162 on the transparent laminar material being in registration adjacent a respective folded sheet 158. In the die-cutting step, the die-cutting would be carried out so that each label 150 includes a respective printed image 162 on the transparent laminar material 154 and a respective folded sheet 158 adjacent thereto.

Figure 13:
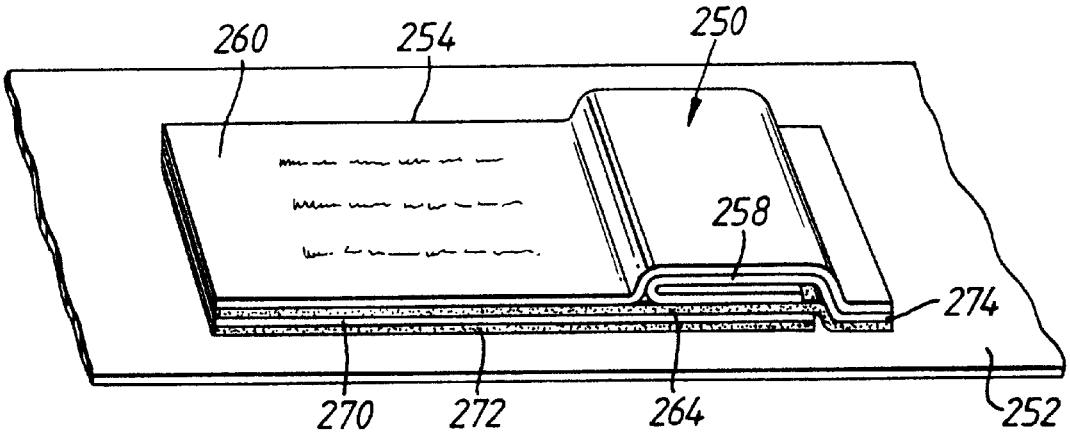
FIG. 13 is a perspective view of a self-adhesive label in accordance with a fifth embodiment of the present invention when carried on a length of release material.

FIG. 13 shows a label 250 in accordance with a fifth embodiment of the present invention when carried on the length of release material 252, the label 250 being a modification of the label of FIG. 12. This embodiment is different from that illustrated in FIG. 12 in that prior to the application of pressure-sensitive adhesive 264 to the release material, the release material is provided thereover with a succession of support webs, each of which comprises a layer of paper or other material which is coated on its rear surface with a pressure-sensitive adhesive and is carried on the release material. These support webs have been produced by die-cutting pressure-sensitive stock, comprising the paper or other material releasably adhered on the release paper, with the waste remnant having been removed. Thus in the apparatus of FIG. 1 the reel 4 comprises the release material 2 with a succession of self-adhesive support webs thereon. Referring to FIG. 13 again, the self-adhesive label 250 has a lower self-adhesive support web 270 e.g. of paper which is coated on its rear surface with a layer 272 of pressure-sensitive adhesive and is releasably adhered to the release material 252. The support web 270 is coextensive with all of the self-adhesive label 250 apart from the free outer edge 274 of the folded sheet 258 which is intended to be releasably adhered to the release material 152. Accordingly, the free outer edge 274 is directly adhered to the release material 252 by the layer 264 of pressure-sensitive adhesive which has been applied over the release material/support web combination by the adhesive applicator 6 shown in FIG. 1.

In the manufacture of the label of FIG. 13, the folded sheets have been applied in succession over the succession of support webs 270 but also ensuring that the portion (i.e the free outer edge) of the folded sheets which is intended to be releasably adhered to the release material is not disposed over a part of the support web but rather is disposed over the release material. Initially, the support web which is carried on the release material is larger than that which is present in the resultant label. During the die-cutting step, the extra peripheral part of the support web is cut simultaneously with the cutting of the laminar material 254 the applied sheet 258 and the pressure-sensitive adhesive 264 and the combined waste web remnant is then removed. Thus in each resultant label the support web 270, together with the rear layer of adhesive 272, is coextensive with the majority of the label 250. The advantage of this configuration is that the support web provides extra strength and rigidity to the resultant self-adhesive labels.

In the illustrated embodiments, the self-adhesive laminar material is coated with a pressure-sensitive adhesive. However, in alternative embodiments, the laminer material is not uniformly coated with pressure-sensitive adhesive, but rather is provided with uncoated patches which, for example, coincide with part or all of the applied folded sheets. In further alternative embodiments, the self-adhesion is provided not by a layer of pressure-sensitive adhesive but by a heat-sealable material such as a hot-melt adhesive, lacquer or plastics material which is subsequently heat sealed.

I claim:

1. A method of producing a succession of self-adhesive labels on a length of release material, which method comprises the steps of:

a) applying a layer of pressure-sensitive adhesive to a surface of a length of release material;

b) applying a succession of individual folded sheets to the layer of pressure-sensitive adhesive on the length of the release material so as to releasably adhere at least a portion of each of the folded sheets directly to the release material by means of the pressure-sensitive adhesive, each folded sheet having an upper panel and a lower panel;

c) applying to the succession of folded sheets on the release material a web of self-adhesive laminar material whereby the laminar material is adhered by the self-adhesive surface thereof over the succession of folded sheets;

d) cutting through the laminar material, the folded sheets and the pressure-sensitive adhesive as far as but not include release material thereby to form the self-adhesive labels, the cutting step being carried out such that the upper panels of the folded sheets with the laminar material adhered thereto are cut and thereby can be pulled away from the lower panel thereby to open the labels when installed, said release material and said pressure sensitive adhesive adapted to allow removal of said folded sheets and a layer of pressure sensitive adhesive together for subsequent adherence to a package using the layer of pressure sensitive adhesive; and e) removing from the release material waste portions of the laminate material, the folded sheets and the pressure-sensitive adhesive which surround the self-adhesive label.

2. A method of producing a succession of self-adhesive labels on a length of release material, which method comprises the steps of:

a) applying a layer of pressure-sensitive adhesive to a surface length of release material;

b) applying a succession of individual folded sheets to the layer of pressure-sensitive adhesive so as to adhere the folded sheets to the release material, each folded sheet having an upper panel and a lower panel, at least a portion of each folded sheet being releasably adhered directly to the release material by means of the pressure-sensitive adhesive, the pressure-sensitive adhesive being adapted to be removed from the release material with the folded sheet;

c) applying to the succession of folded sheets on the release material a web of a self-adhesive laminar material whereby the laminar material is adhered by the self-adhesive surface thereof over the succession of folded sheets;

d) cutting through the laminar material, the folded sheets and the pressure-sensitive as far as the release material thereby to form the self-adhesive labels, the cutting step being carried out such that the upper panel of the folded sheets with the laminar material adhered thereto are cut and thereby can be pulled away from the lower panels thereby to open the labels; and e) removing from the release material waste portions of the laminar material, the folded sheets and the pressure-sensitive adhesive which surround the self-adhesive labels wherein each folded sheet has a folded edge between the upper panel and the lower panel, the upper panel having at least one hole therethrough adjacent a folded edge which exposes a respective at least one part of the lower panel, the self-adhesive laminar material extends over the said at least one hole of each folded sheet thereby to form at least one self-adhesive exposed portion of the laminar material which is adhered to the lower panel and the cutting step is carried out whereby each folded edge is cut away from the respective self-adhesive label.

3. A method according to claim 2 wherein in applying step (b) the folded sheets are fed onto the layer of pressure-sensitive adhesive which is carried on the release material at a label applying station under which the length of release material is conveyed, and wherein the leading edge of each folded sheet is comprised of the said folded edge.

4. A method according to claim 1 wherein the folded sheet further comprises at least one additional folded panel which is connected to the lower panel.

5. A method according to claim 1 wherein the folded sheet further comprises at least one additional folded panel which is connected to the upper panel.

6. A method according to claim 1, wherein in cutting step (d) a weakened tear line is also cut through the laminar material which can be torn thereby to permit the upper panels to be pulled away from the lower panels.

7. A method according to claim 1 wherein each folded sheet has a folded edge between the respective upper panel and the respective lower panel whereby in the respective self-adhesive label the respective upper panel with the laminar material applied thereto can be pulled away from the respective lower panel by unfolding the respective label about the folded edge.

8. A method according to claim 7, wherein in the cutting step (d), the laminar material and the pressure-sensitive adhesive are cut along a line spaced from the folded edges thereby to form flaps of the laminar material which are adjacent to the folded edges and are adhered to the release material.

9. A method according to claim 7 wherein the laminar material comprises a transparent plastics material which is provided with a succession of printed images thereon, in step (c) the laminar material is applied whereby each image is in registry with a respective folded sheet and in step (d) the laminar material is cut so as to provide a label portion, which includes at least a part of the respective image, adjacent a respective folded sheet.

10. A method according to claim 8 wherein in the cutting step the edges of the folded sheet apart from the said folded edge are cut away.

11. A self-adhesive label comprising an upper panel, a lower panel having a self-adhesive rear surface and which is carried on a backing of release material, at least a portion of the label being directly releasably adhered to the release material by means of the self-adhesive rear surface, a folded edge connecting the upper and lower panels and a self-adhesive laminar material which is adhered by the self-adhesive surface thereof to an upper surface of the upper panel, the laminar material connecting the upper panel to the lower panel so as to maintain the label in close configuration and being configured such that the upper panel can be pulled away from the lower panel to open the label.

12. A self-adhesive label according to claim 11 wherein the laminar material has a perforation line extending thereacross which can be torn thereby to permit access to the lower panel.

13. A self-adhesive label comprising an upper panel having at least one hole therethrough adjacent an edge of the upper panel, the lower panel having a self-adhesive rear surface and which is carried on a backing of a release material, the lower panel being separate from the upper panel, the lower and upper panels having been formed from a single folded sheet and having been separated by cutting away of a common folded edge therebetween, and a self-adhesive laminar material which is adhered by the self-adhesive surface thereof to the upper surface of the upper panel, the laminar material extending over at least one hole thereby to form at least one self-adhesive exposed portion of the laminar material which is adhered to the lower panel, at least a portion of the label being directly releasably adhered to the release material by the self-adhesive rear surface, wherein the upper panel covers and extends beyond the lower panel and the upper panel has a self-adhesive rear surface which is adjacent the self-adhesive rear surface of the lower panel and is carried on the backing of release material.

14. A self-adhesive label according to claim 13 further comprising at least one additional panel which is connected to the lower panel and is disposed between the upper and lower panels.

15. A self-adhesive label comprising a folded sheet having an upper panel, a lower panel, a folded edge connecting the upper and lower panels, a part of the upper panel extending past an edge of the lower panel whereby a rear surface of the folded sheet comprises a rearwardly-directed surface of the lower panel and the part of the upper panel extending past the edge of the lower panel, a self-adhesive laminar material which covers the upper panel and extends past the folded edge to form end portions thereof and a layer of pressure-sensitive adhesive which coats the rear surface of the folded sheet and a rearwardly-directed surface of the end portion of the laminar material, at least a portion of the folded sheet being directly adhered to the release material by means of the pressure-sensitive adhesive, the pressure-sensitive adhesive and release material adapted for the pressure-sensitive adhesive to be removed from the release material with the folded sheet, to be reused for attaching the folded sheet to a package.

16. A self-adhesive label according to claim 15 wherein the laminar material is of transparent plastics and the end portion of the laminar material carries an image which has been printed thereon.

17. A self-adhesive label comprising a self-adhesive support web carried on a backing of release material, a folded sheet disposed on the support web, the folded sheet including an upper panel having a folded edge at which the upper panel is connected to a lower panel of the sheet and an opposite free outer edge, the folded edge being disposed over the support web and the free outer edge extending past the support web and over the backing of release material, the free outer edge being releasably adhered to the release material by means of pressure sensitive adhesive, and a self-adhesive laminar material which covers the upper panel and extends past the folded edge to form an end portion thereof which is adhered to the support web and the free outer edge being releasably held adjacent the release material thereby to retain the sheet in its folded configuration.

18. A self-adhesive label according to claim 17 further comprising at least one additional panel which is disposed between the upper and lower panels.

19. A self-adhesive label according to claim 17 wherein the sides of the label between the folded edge and the free outer edge consist of coincident edges of the laminar material, folded sheet and support web.

20. A self-adhesive label according to claim 17 wherein the end portion of the laminar material and the underlying part of the support web to which the laminar material is adhered are coextensive.

21. A method of producing a succession of self-adhesive labels on a length of release material, which method comprises the steps of:

(a) providing a succession of self-adhesive support webs carried on a length of release material;

(b) applying a succession of folded sheets to the succession of support webs, each folded sheet comprising an upper panel connected to a lower panel by a folded edge, each sheet being applied whereby the folded edge is disposed over the support web and a free outer edge of the upper panel, which free outer edge is opposite the folded edge, is disposed over the release material and is releasably adhered to the release material by pressure-sensitive adhesive;

(c) adhering over the folded sheets and the support webs a self-adhesive laminar material whereby the laminar material is adhered by the self-adhesive surface thereof to the folded sheets and exposed parts of the support webs;

(d) cutting through the laminar material, the folded sheets and the support webs as far as the release material to form the self-adhesive labels, whereby in each label the laminar material extends past the folded edge to form an end portion thereof which is adhered to the support web and the free outer edge is releasably held adjacent the release material thereby to retain the sheet in its folded configuration; and (e) removing from the release material waste portions of the laminar material, of the folded sheets and of the support webs which surround the self-adhesive labels.

22. A method according to claim 21 wherein the succession of self-adhesive support webs carried on the length of release material is produced by die-cutting pressure-sensitive stock comprising a self-adhesive material carried on a release material and removing the waste web remnant.

23. A method according to claim 21 wherein the folded sheet further includes at least one additional panel which is disposed between the upper and lower panels.

24. A method according to claim 21 wherein the cutting step (d) is carried out whereby the opposed sides of the label between the folded edge and the free outer edge consist of coincident edges of the laminar material, folded sheet and support web.

25. A method according to claim 21 wherein the cutting step (d) is carried out whereby the end portion of the laminar material and the underlying part of the support web to which the laminar material is adhered are coextensive.

26. A self-adhesive label carried on a release material comprising a lower panel having a self-adhesive rear surface which is adhered to a release material, a folded portion which covers one edge region of the lower panel, the folded portion including an upper panel and a self-adhesive laminar material which is adhered by its self-adhesive surface to the upper surfaces of the lower panel and the upper panel and the laminar material extending past the folded portion thereby to form an end portion which is directly adhered to the release material.

27. A self-adhesive label according to claim 26 wherein the lower panel is shorter than the laminar material and the upper surface of the lower panel and the upper panel are entirely covered by the laminar material.

28. A self-adhesive label according to claim 26 wherein the rear self-adhesive surface of the label comprises the rear surfaces of the lower panel and the end portion of the laminar material.

29. A self-adhesive label according to claim 26 wherein the folded portion is connected to the lower panel by a fold line.

30. A method of producing a succession of self-adhesive labels carried on a length of release material, the method comprising the steps of:

(a) providing on a length of release material a succession of label portions comprising a lower panel releasably adhered to the release material by pressure-sensitive adhesive, and a folded portion, including an upper panel, which covers one edge region of the lower panel;

(b) adhering over the succession of label portions a self-adhesive laminar material whereby the laminar material is adhered by the self-adhesive surface thereof to the upper surfaces of the lower and upper panels and to portions of the release material between the label portions;

(c) cutting through the laminar material and the label portions as far as the release material to form a succession of self-adhesive labels whereby in each label the laminar material extends past the folded portion thereby to form an end portion which is adhered to the release material; and (d) removing from the release material waste portions of the laminar material and of the label portions which surround the self-adhesive labels.

31. A method according to claim 30 wherein in step (b) the upper surfaces of the lower and upper panels are entirely covered by the laminar materials.

32. A method according to claim 30 wherein the rear surface of each self-adhesive label comprises the rear surface of the lower panel and the end portion of the laminar material.

33. A method according to claim 30 wherein the folded portion is connected to the lower panel by a fold line.

* * * * *